US008721295B2

(12) United States Patent
Sugiura et al.

(10) Patent No.: US 8,721,295 B2
(45) Date of Patent: May 13, 2014

(54) VACUUM PUMP SELF-DIAGNOSIS METHOD, VACUUM PUMP SELF-DIAGNOSIS SYSTEM, AND VACUUM PUMP CENTRAL MONITORING SYSTEM

(75) Inventors: Tetsuro Sugiura, Tokyo (JP); Keiji Tanaka, Tokyo (JP); Toshiharu Nakazawa, Tokyo (JP); Koichi Kido, Tokyo (JP); Tomoyuki Yamazaki, Tokyo (JP)

(73) Assignee: Ebara Corporation, Tokyo (JP)

( * ) Notice: Subject to any disclaimer, the term of this patent is extended or adjusted under 35 U.S.C. 154(b) by 1438 days.

(21) Appl. No.: 11/813,716

(22) PCT Filed: Apr. 7, 2006

(86) PCT No.: PCT/JP2006/307878

§ 371 (c)(1),
(2), (4) Date: Oct. 10, 2007

(87) PCT Pub. No.: WO2006/109861

PCT Pub. Date: Oct. 19, 2006

(65) Prior Publication Data

US 2009/0035151 A1 Feb. 5, 2009

(30) Foreign Application Priority Data

Apr. 8, 2005 (JP) ..... 2005-112373

(51) Int. Cl.
*F04B 37/14* (2006.01)
*F04B 49/00* (2006.01)

(52) U.S. Cl.
USPC ..... 417/44.2; 417/63

(58) Field of Classification Search
USPC ..... 417/44.11, 63, 44.2, 44, 634; 700/282
See application file for complete search history.

(56) References Cited

U.S. PATENT DOCUMENTS 5,718,565 A * 2/1998 Kuhn et al. ..... 417/44.3
5,767,635 A 6/1998 Steffens et al.

(Continued)

FOREIGN PATENT DOCUMENTS

CN 1419045 A 5/2003
JP 05-118289 5/1993

(Continued)

OTHER PUBLICATIONS

Office Action issued Apr. 22, 2011, in Japanese Patent Application No. 2007-544661.

*Primary Examiner* — Charles Freay
*Assistant Examiner* — Philip Stimpert
(74) *Attorney, Agent, or Firm* — Oblon, Spivak, McClelland, Maier & Neustadt, L.L.P.

(57) ABSTRACT

There are provided a vacuum pump self-diagnosis method, a vacuum pump self-diagnosis system, a vacuum pump central monitoring system capable of making self-diagnosis of a dry vacuum pump. A vacuum pump self-diagnosis method decides the occurrence of failure and generates an alarm when a predetermined alarm set value is exceeded by an integrated value or an average value of a current of a motor for rotating a rotor of said vacuum pump. In a vacuum pump self-diagnosis system for making self-diagnosis of a vacuum pump which comprises a casing and a rotor rotatably arranged in the casing for sucking and discharging a gas through rotations of the rotor, the rotor comprises a plurality of stages and a pressure sensor is provided between the rotor stages. A self-diagnosis unit is provided for calculating an integrated value or an average value of a current of a motor for rotating said rotor, and making self-diagnosis of the vacuum pump when the integrated value or average value exceeds a predetermined alarm set value. The self-diagnosis unit switches from one self-diagnosis calculation method to another or interrupts the self-diagnosis calculation based on a pressure value detected by said pressure sensor.

8 Claims, 10 Drawing Sheets

(56) References Cited

U.S. PATENT DOCUMENTS

| | | | | |
|---|---|---|---|---|
| 6,244,825 | B1 | 6/2001 | Sasaki et al. | |
| 6,665,576 | B2 * | 12/2003 | Hayashi | 700/121 |
| 2002/0006477 | A1 * | 1/2002 | Shishido et al. | 427/569 |
| 2003/0009311 | A1 * | 1/2003 | Ushiku et al. | 702/184 |
| 2003/0158705 | A1 * | 8/2003 | Ishii et al. | 702/183 |

FOREIGN PATENT DOCUMENTS

| | | |
|---|---|---|
| JP | 05 118289 | 5/1993 |
| JP | 5-118289 | 5/1993 |
| JP | 06 026460 | 2/1994 |
| JP | 06-026460 | 2/1994 |
| JP | 08 019908 | 1/1996 |
| JP | 11 062846 | 3/1999 |
| JP | 2000 064964 | 3/2000 |
| JP | 2000-110735 | 4/2000 |
| JP | 2001-041166 | 2/2001 |
| JP | 2002-285974 | 10/2002 |
| JP | 2003-77907 | 3/2003 |
| JP | 2003-077907 | 3/2003 |
| JP | 2003 232292 | 8/2003 |
| JP | 2003-232292 | 8/2003 |
| JP | 2004-121341 | 4/2004 |
| JP | 2005 009337 | 1/2005 |

* cited by examiner

VACUUM PUMP SELF-DIAGNOSIS METHOD, VACUUM PUMP SELF-DIAGNOSIS SYSTEM, AND VACUUM PUMP CENTRAL MONITORING SYSTEM

FIELD OF THE INVENTION

The present invention relates to a vacuum pump self-diagnosis method, a vacuum pump self-diagnosis system, and a vacuum pump central monitoring system for making self-diagnosis of a dry vacuum pump in which by-products are deposited due to reactions in processes.

DESCRIPTION OF BACKGROUND ART

In recent years, the diameter of semiconductor wafers and the size of liquid crystal boards have been progressively increased with increasingly higher integration of semiconductor devices, resulting in a higher unit price per semiconductor wafer and liquid crystal board. For this reason, it is necessary to stabilize manufacturing processes to increase the product yield rate. Particularly, stable operations have been regarded as a critical challenge for devices which directly affect the manufacturing processes, such as a dry vacuum pump.

With a batch processing apparatus which processes a large number of wafers in batch in a single process such as LP-CVD (Low-Pressure Chemical Vapor Deposition) used in semiconductor device manufacturing, if a dry vacuum pump suddenly stops during the processing, a large number of semiconductor wafers are damaged to possibly cause major losses. On the other hand, in regard to liquid crystals, an increase in size has been progressed to such an extent that the board area exceeds 4 $m^2$, so that damaged boards would result in a tremendous loss. See Japanese Patent Laid-open No. 2005-9337.

In situations as mentioned above, a demand has been increased for a system which makes self-diagnosis of dry vacuum pumps and provides a safeguard against the failures beforehand to prevent damages in products. At present, a central monitoring system manages the operation of multiple dry vacuum pumps for satisfying the demand. This current central monitoring system, though capable of monitoring multiple dry vacuum pumps for operating situations with a few computers (personal computers), does not have a function of making self-diagnosis of the dry vacuum pumps.

DISCLOSURE OF THE INVENTION

The present invention has been made in view of the foregoing aspect, and it is an object of the invention to provide a vacuum pump self-diagnosis method, a vacuum pump self-diagnosis system, and a vacuum pump central monitoring system.

To solve the above problem, a vacuum pump self-diagnosis method set forth in claim 1 is a vacuum pump self-diagnosis method for making self-diagnosis of a vacuum pump, characterized in that self-diagnosis is made to generate an alarm when a predetermined alarm set value is exceeded by an integrated value or an average value of a current of a motor for rotating a rotor of the vacuum pump.

A vacuum pump self-diagnosis method set forth in claim 2 is characterized in that the alarm set value is the sum of an average current value during an initial operation of the motor and a predetermined value $\alpha$ in the vacuum pump self-diagnosis method according to claim 1.

A vacuum pump self-diagnosis method set forth in claim 3 is characterized in that the self-diagnosis of the vacuum pump is determined on the basis of the number of times the current value of the motor exceeds the alarm set value per unit time in the vacuum pump self-diagnosis method according to claim 1 or 2.

A vacuum pump self-diagnosis system set forth in claim 4 is a vacuum pump self-diagnosis system for making self-diagnosis of a vacuum pump which comprises a casing, and a rotor rotatably arranged in the casing for sucking and discharging a gas through rotations of the rotor, characterized in that the vacuum pump comprises a plurality of stages of the rotors, a pressure sensor arranged between the rotor stages, and a self-diagnosis unit for calculating an integrated value or an average value of a current of a motor for rotating the rotor, and making self-diagnosis of the vacuum pump when the integrated value or average value exceeds a predetermined alarm set value, and the self-diagnosis unit switches from one self-diagnosis calculation method to another or interrupts the self-diagnosis calculation based on a pressure value detected by the pressure sensor.

A vacuum pump self-diagnosis system set forth in claim 5 is characterized in that the self-diagnosis unit is arranged in a control unit within the body of the vacuum pump in the vacuum pump self-diagnosis system according to claim 4.

A vacuum pump failure central monitoring system set forth in claim 6 is a vacuum pump central monitoring system which comprises a plurality of network adapters for connecting a plurality of vacuum pumps to a network, and a central monitoring computer for intensively monitoring the plurality of network adapters, wherein pump data sent from each vacuum pump through the network adapter is monitored by the central monitoring computer. The vacuum pump central monitoring system is characterized by a pump self-diagnosis adapter disposed between the vacuum pump and the adapter and comprising a self-diagnosis unit for making self-diagnosis of the vacuum pump, or a self-diagnosis unit disposed in the network adapter for making self-diagnosis of the vacuum pump.

A vacuum pump failure central monitoring system set forth in claim 7 is characterized in that the pump self-diagnosis adapter or network adapter comprises a pump data storage unit for storing data on the vacuum pumps, and the self-diagnosis unit makes self-diagnosis of the vacuum pump based on the pump data in the pump data storage unit in the vacuum pump central monitoring system according to claim 6.

According to the vacuum pump self-diagnosis method set forth in claims 1 to 3, since self-diagnosis is made when the alarm set value is exceeded by an integrated value or an average value of the current of the motor for rotating the rotor of the vacuum pump, it is possible to provide a vacuum pump self-diagnosis method which can simply and accurately make self-diagnosis of the vacuum pump. Particularly, in the invention set forth in claim 2, the predetermined value $\alpha$ is added to an average current value during an initial operation of the motor to create the alarm set value, the alarm set value can be set in conformity to a particular pump even when the current value of the motor varies due to individual differences among pumps. Also, in the invention set forth in claim 3, since a failure is determined on the basis of the number of times the current value of the motor exceeds the alarm set value per unit time, it is possible to accurately detect a state in which the pump is about to fail.

According to the vacuum pump self-diagnosis system set forth in claims 4 and 5, the pressure sensor is arranged between the rotor stages, and the self-diagnosis unit is provided for calculating an integrated value or an average value of the current of the motor for rotating the rotor, and making self-diagnosis of the vacuum pump when the integrated value or average value exceeds a predetermined alarm set value, wherein the self-diagnosis unit switches from one self-diagnosis calculation method to another or interrupts the self-diagnosis calculation based on a pressure value detected by the pressure sensor, thus making it possible to provide a vacuum pump self-diagnosis system which is capable of accurately making self-diagnosis of a dry vacuum pump which is applied with a varying pump load due to variations in inflow gas amount.

According to the vacuum pump failure central monitoring system set forth in claims 6 and 7, since the pump self-diagnosis adapter comprising the self-diagnosis unit for making self-diagnosis of the vacuum pump is disposed between the vacuum pump and adapter, or the self-diagnosis unit is disposed in the network adapter for making self-diagnosis of the vacuum pump, it is possible to simply provide, for example, an existing vacuum pump central monitoring system with a function of making self-diagnosis of each vacuum pump.

BEST MODE FOR CARRYING OUT THE INVENTION

One embodiment of the present invention will hereinafter be described with reference to the drawings. In dry vacuum pumps used for manufacturing semiconductor devices and liquid crystal boards, reaction by-products resulting from process exhaust often deposit within pumps to make the same inoperative. Particularly, this tendency is prominent in dry vacuum pumps for heavy load processes such as P-CVD (Plasma-CVD) used in liquid crystal board manufacturing processes, LP-CVD used in semiconductor device manufacturing processes, and the like, which involve a large amount of reaction by-products caused thereby. The present invention provides a vacuum pump self-diagnosis method, a vacuum pump self-diagnosis system, and a vacuum pump central monitoring system which are suitable for making self-diagnosis of such dry vacuum pumps for heavy load processes.

Figure 4:
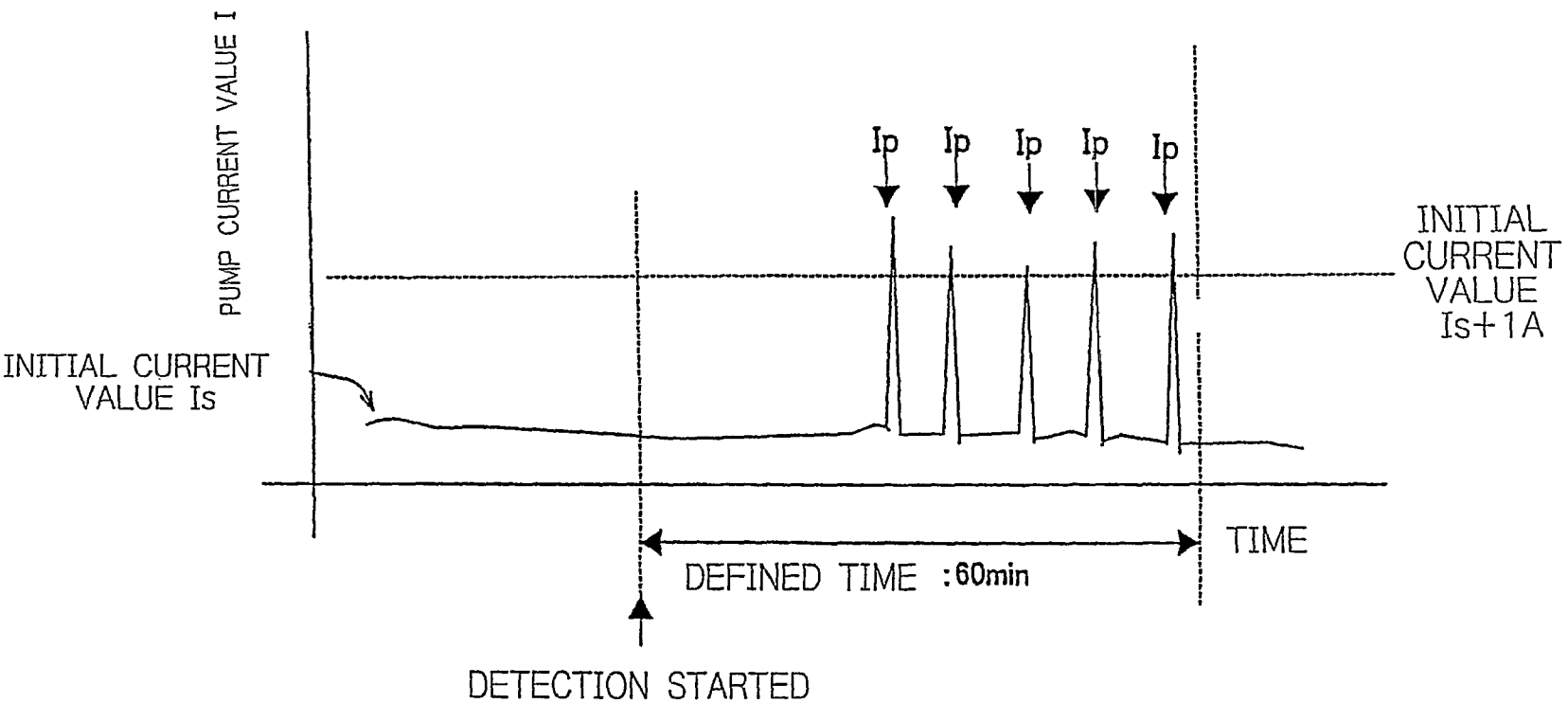
FIG. 4 is a diagram for describing a self-diagnosis method which relies on the number of times a pump current is generated in a main pump according to the present invention.

Failures in dry vacuum pumps for heavy load processes are mainly caused by reaction by-products which flow into and deposit within the dry vacuum pumps and thereby lock their rotors. When reaction by-products deposit within the dry vacuum pumps, the rotor slides into contact with the reaction by-products deposited in a space between the rotor and a casing, causing a gradually increased load on the pump, a gradual increase in a current value of a motor which drives the rotor, and an eventual overload which stops the pump. On the other hand, since the deposited reaction by-products may cause a rise in temperature within a pump, it is thought that temperature is used for pump self-diagnosis. But, the temperature is also affected by a cooling water and the like other than the reaction by-products, so that the current value of the motor for driving the pump (for rotating the rotor) (hereinafter called the "pump current value") more directly contributes to a detection of such deposited by-products within the pump. In the following, a description will be given of a vacuum pump self-diagnosis method for monitoring a pump current value to make self-diagnosis of a dry vacuum pump. FIG. 4 is a diagram for describing how self-diagnosis of a main pump is made from pulses appearing in a pump current.

Figure 1:
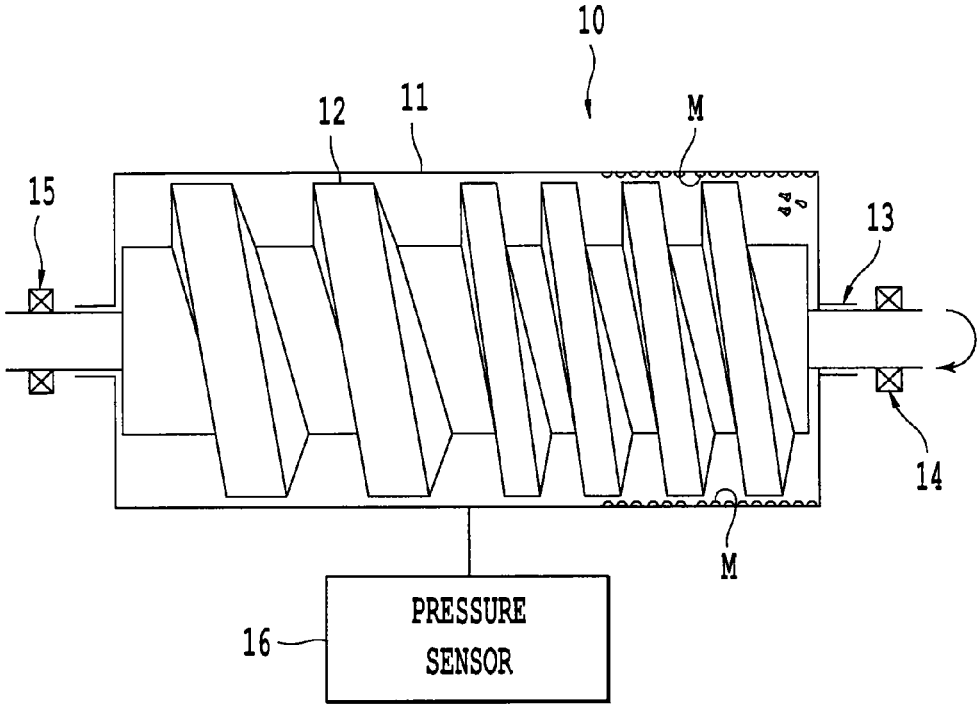
FIG. 1 is a diagram generally illustrating an exemplary configuration of a screw dry vacuum pump used for a main pump.
Figure 2:
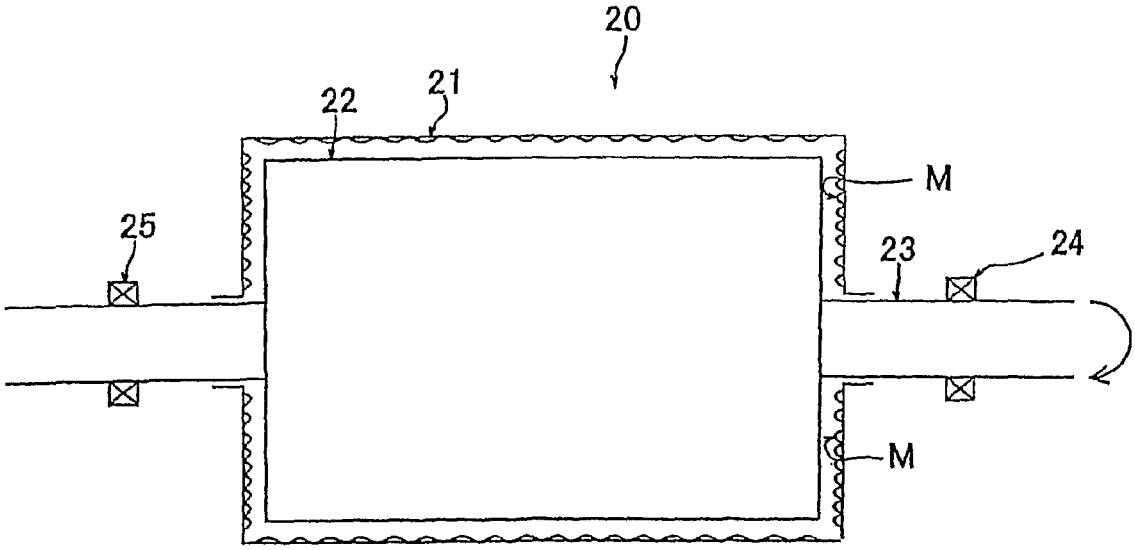
FIG. 2 is a diagram generally illustrating an exemplary configuration of a Roots dry vacuum pump used for a booster pump.

Vacuum pumps for a heavy load process comprise a main pump for driving from the atmospheric pressure, and a booster pump which operates as an auxiliary pump for assisting the main pump. A screw dry vacuum pump is, the configuration of which is illustrated in FIG. 1, is used for the main pump, while a Roots dry vacuum pump, the configuration of which is illustrated in FIG. 2, is used for the auxiliary pump. As illustrated in FIG. 1, the screw dry vacuum pump 10 is configured to contain a screw rotor 12 in a casing 11 and a main shaft 13 is rotatably supported by bearings 14, 15. On the other hand, the Roots dry vacuum pump 20 is configured to contain a Roots rotor 22 in a casing 21, as illustrated in FIG. 2, and a main shaft 23 is rotatably supported by bearings 24, 25.

In the screw dry vacuum pump 10, a reaction by-product M deposits on the inner surface of the casing 11 near a discharge port, as illustrated in FIG. 1, and the screw rotor 2 slides into contact with the deposited reaction by-product M. In the Roots dry vacuum pump 20, in turn, a reaction by-product M deposits on the inner surface of the casing 21, as illustrated in FIG. 1, and the side surface of the Roots rotor 22 slides into contact with the deposited reaction by-product M.

Figure 3:
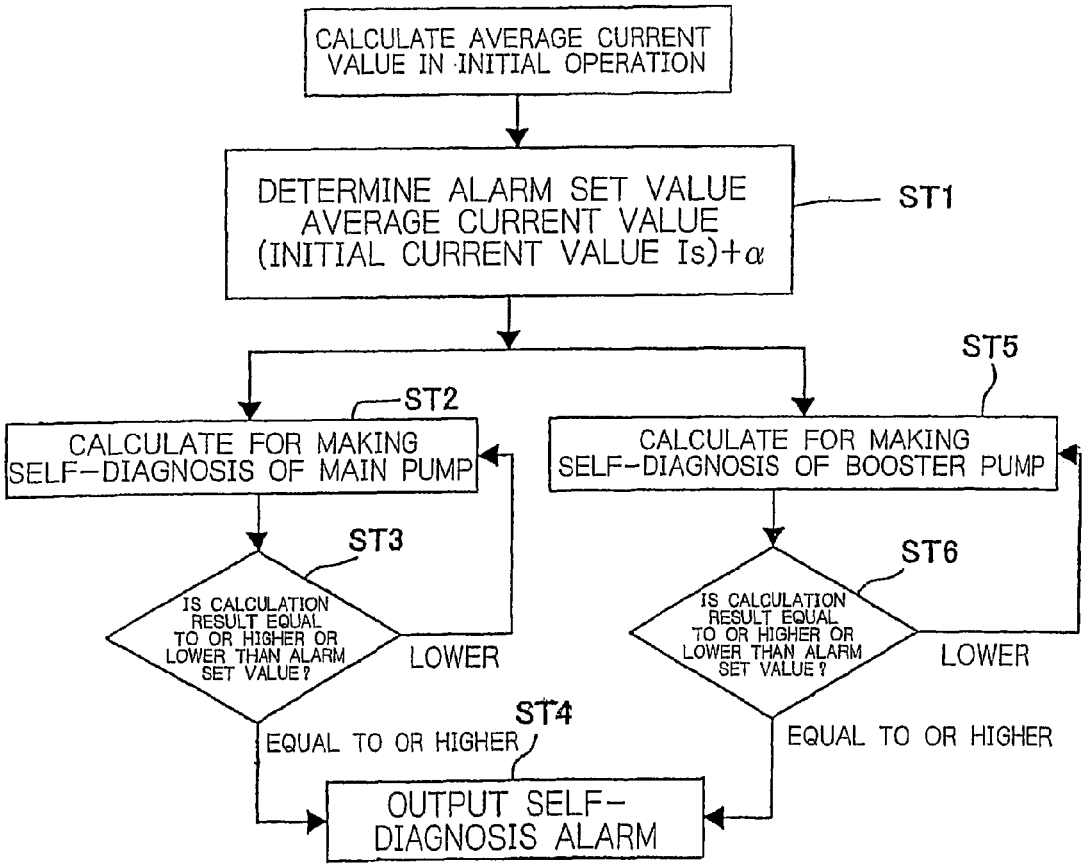
FIG. 3 is a diagram illustrating a processing flow of a vacuum pump self-diagnosis method according to the present invention.

FIG. 3 is a diagram illustrating a processing flow of a vacuum pump self-diagnosis method according to the present invention. In this flow, different self-diagnosis calculations are made for the screw dry vacuum pump which is the main pump and the Roots dry vacuum pump which is a booster pump because they differ in the behavior of a pump current value associated with the deposited reaction by-product. First, an alarm set value is determined for a criterion of a self-diagnosis diagnosis, followed by the self-diagnosis calculations for the main pump and booster pump. When the main pump is a Roots vacuum pump, the self-diagnosis calculation made therefor is similar to that of the booster pump.

[Determination of Self-Diagnosis Alarm Set Value]

First, a self-diagnosis alarm set value is determined at step ST1. The pump current value may vary due to individual differences and the like. For this reason, for determining the alarm set values for the respective pumps, the pump current value is averaged over an initial operating time, and this average current value is designated an initial current value Is. Then, a predetermined value $\alpha$ is added to the initial current value Is, and the resulting sum is chosen to be the alarm set value. That is, alarm set value=Is+$\alpha$. The initial current value Is can be obtained by automatically calculating the average of the pump current value for 12 hours after the pump has started the operation. Also, the value of +$\alpha$ is set to approximately +10% of the initial current value Is for the main pump, and to approximately +50% of the initial current value Is for the booster pump. The value of +$\alpha$ may be set to approximately +10% for the main pump because the pump current value of the main pump is hardly affected by an inflow gas rate and the like and is therefore relatively stable, whereas the value of +$\alpha$ may be set to approximately +50% for the booster pump because the pump current value of the booster pump is more likely to be affected by an inflow gas rate and largely varies.

After the fault prediction alarm set values have been determined at step ST1, the self-diagnosis calculation is made for the main pump at step ST2. Subsequently, it is determined at step ST3 whether or not the result of the calculation made in step ST2 is lower or equal to or higher than the alarm set value. If the result is lower than the alarm set value, the flow returns to step ST2 to repeat the processing, whereas if the result is equal to or higher than the alarm set value, a self-diagnosis alarm is generated at next step ST4. Further, following to step ST1, the self-diagnosis calculation is made for the booster pump at step ST5. Subsequently, it is determined at step ST6 whether or not the result of the calculation made at step ST5 is lower or equal to or higher than the alarm set value. If lower than the alarm set value, the flow returns to step ST5 to repeat the processing, whereas if equal to or higher than the alarm set value, a self-diagnosis alarm is generated at next step ST4.

[Main Pump Self-Diagnosis]

FIG. 4 is a diagram for describing how self-diagnosis of the main pump is made. In the screw dry vacuum pump, when the reaction by-product M has gradually deposited on the inner surface of the casing 11 as illustrated in FIG. 1, the screw rotor 12 operates to rake out the reaction by-product. In this event, since the rotor 12 is instantaneously loaded, the pump current value I instantaneously rises, as illustrated in FIG. 4. Thus, the pump current value I exceeds the initial current value Is +1 A to reach a peak current value Ip in a pulsative manner. As the amount of the reaction by-product M increasingly sticks to the inner surface, the peak current value Ip is frequently generated due to the rotor raking out the reaction by-product M. Eventually, an amount of the reaction by-product M, which can no longer be raked out, deposits between the rotor 12 and the casing 11, to cause an overload on the rotor 12, which slides into contact with the reaction by-product M. Paying attention to this behavior, a self-diagnosis alarm set value is selected on the basis of the number of times the peak current value Ip is generated for a unit time (every 60 minutes in FIG. 4). Then, the number of times the peak current value Ip is actually generated is counted, such that the self-diagnosis alarm is outputted when the count is increased to the self-diagnosis alarm set value or higher.

[Booster Pump Self-Diagnosis]

Figure 5:
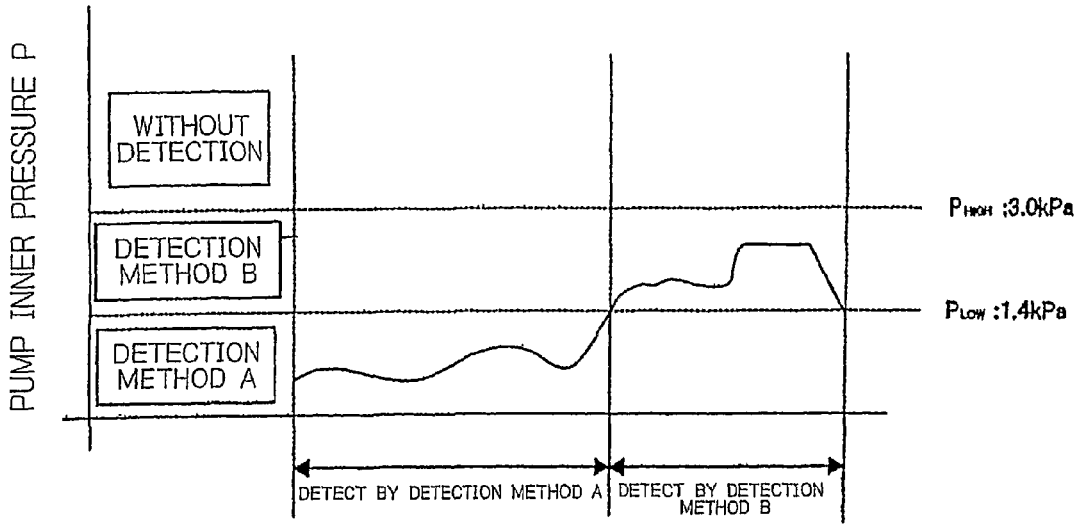
FIG. 5 is a diagram for describing a self-diagnosis method which relies on the inner pressure of a booster pump according to the present invention.
Figure 6:
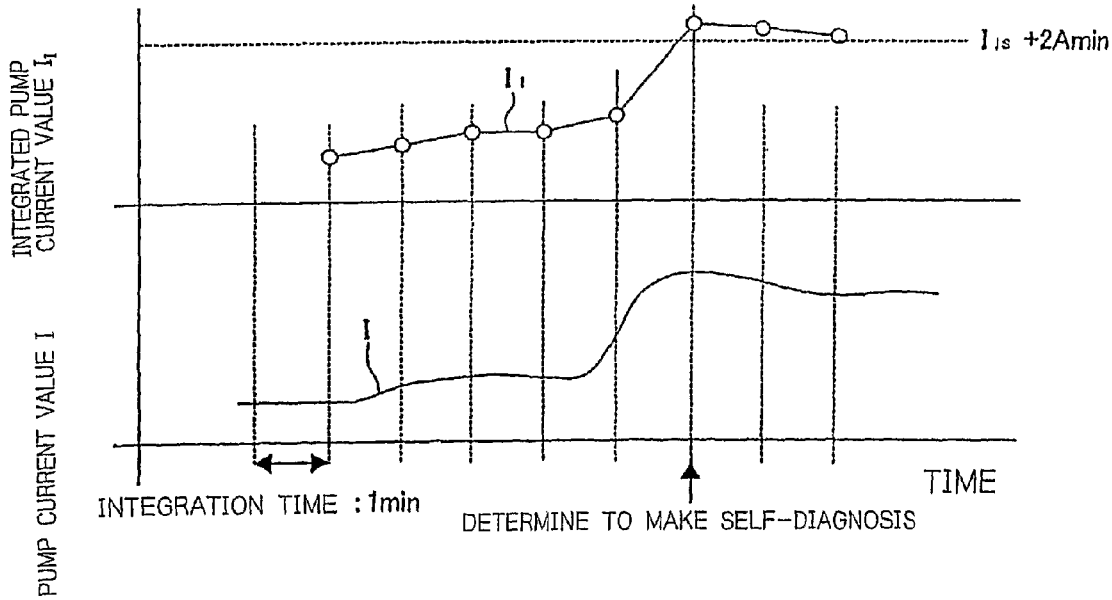
FIG. 6 is a diagram for describing a self-diagnosis method which relies on an integrated pump current value of the booster pump according to the present invention.
Figure 7:
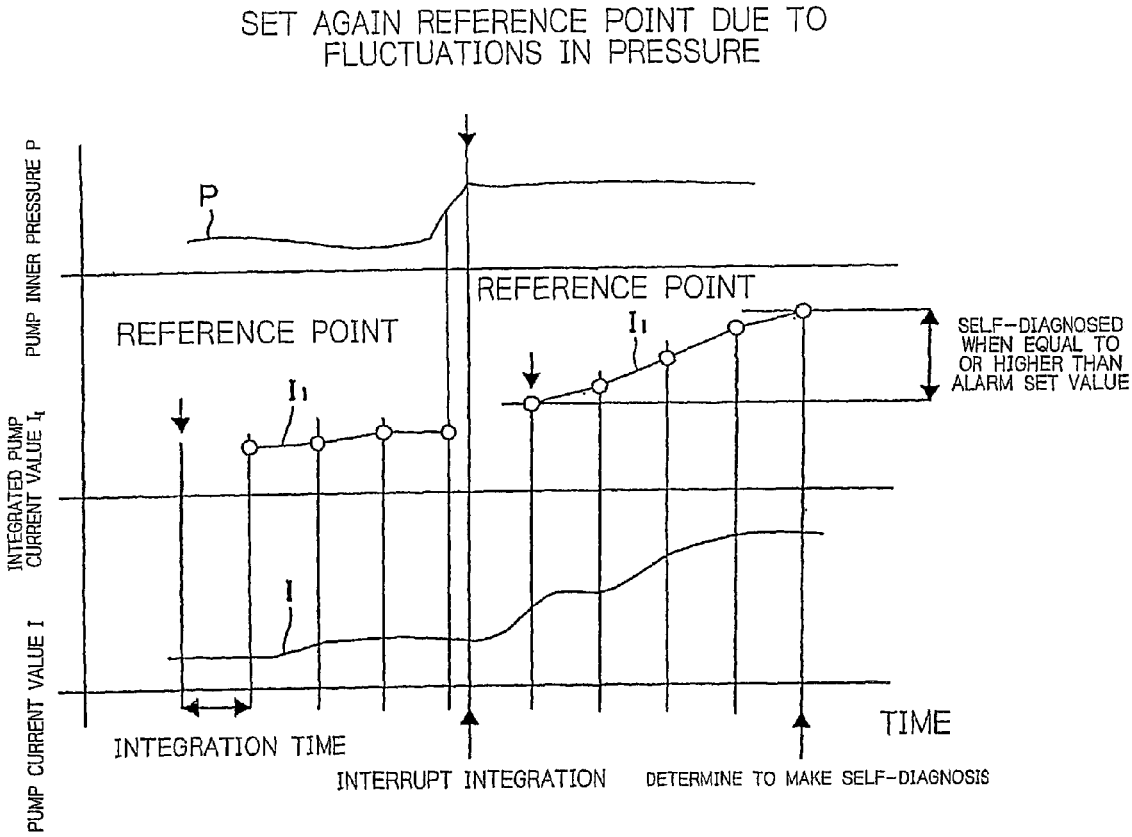
FIG. 7 is a diagram for describing a self-diagnosis method which relies on an integrated pump current value and a pump inner pressure of the booster pump according to the present invention.

FIGS. 5 to 7 are diagrams for describing a booster pump self-diagnosis. In the Roots booster pump, when the reaction by-product M has deposited on the inner surface of the casing 21 as illustrated in FIG. 2, the side surface of the rotor 22 slides into contact with the reaction by-product M deposited on the side surface of the casing 21. The pump current value I gradually rises, as shown in FIG. 6, due to the rotor 22, the side surface of which slides into contact with the reaction by-product M deposited on the side surface of the casing 21. As the amount of the reaction by-product M increasingly sticks and the gap between the side surface of the rotor 22 and the side surface of the casing 21 is closed, the rotor 22 is overloaded due to a sliding contact and made immobile. Thus, the pump current value I is integrated for a predetermined integration time (one minute in FIG. 6) to calculate an integrated pump current value $I_I$ as shown in FIG. 6. An alarm is generated when this integrated pump current value $I_I$ reaches or exceeds a self-diagnosis alarm set value which is set to an integrated pump current value (initial integrated pump current value $I_{IS}$+2 A min in FIG. 6). P However, since the booster pump is characteristically affected by the amount of gas flowing into the pump to largely vary the pump current value I, it is necessary to determine whether an increase in the pump current value I is caused by an inflow gas or the deposited reaction by-product M. Therefore, focusing attention on the fact that the inner pressure of the pump increases when a gas flows into the pump, it is preferable that a pressure sensor 16 is mounted between casing stages (between stages of the main pump comprising rotors at two stages) and that any failure is decided by simultaneously monitoring a pressure value detected by the pressure sensor and the pump current value. FIG. 5 is a diagram for describing a change in the pump inner pressure P, which is a pressure value detected by the pressure sensor, and a detection method.

The pump inner pressure value is used to switch self-diagnosis calculations, as described below. Since an inflow gas amount varies from one process to another, such as a deposition process, a cleaning process and the like, a lower pressure set value $P_{LOW}$ is set at a level higher than the pump inner pressure value in a process which involves a small amount of gas, such as the deposition process, as shown in FIG. 5. Also, an upper pressure set value $P_{HIGH}$ is set at a level higher than the pump inner pressure value in a process which involves a large amount of gas such as the cleaning process.

(1) During Atmosphere Pressure Pumping:

During atmospheric pressure pumping, the pump inner pressure P extremely rises with an associated increase in the pump current value I. In such an event, a determination is made that an increase in the pump current value I is not attributable to the reaction by-product at the time the pump inner pressure reaches the pressure set value $P_{HIGH}$ or higher to cancel the calculation for self-diagnosis.

(2) When Pump Inner Pressure P is Equal to or Lower Than Pressure Set Value $P_{LOW}$:

In a region of the pump inner pressure equal to or lower than the pressure set value $P_{LOW}$, where the amount of gas is relatively small such as during the introduction of a deposition gas, the pump current value I is integrated for a fixed integration time to find the integrated value $I_I$, and an alarm is generated when the integrated value $I_I$ reaches the alarm set value (initial integrated pump current value $I_{IS}$+2A min) or higher (a detection method A in FIG. 6).

(3) When Pump Inner Pressure P is Equal to or Higher Than Pressure Set Value $P_{LOW}$:

When a large amount of gas is involved such as during the introduction of a cleaning gas, the pump inner pressure P largely increases, causing large variations in the pump current value I of the booster pump. When the pump inner pressure P increases to the pressure set value $P_{LOW}$ or higher, the integration calculation in (2) above is aborted, and the integration of the pump current value I is newly started to set again an alarm set value. An alarm is generated when the integrated value $I_I$ of the pump current value I exceeds this alarm set value (a detection method B in FIG. 7).

[Vacuum Pump Self-Diagnosis System]

Figure 8:
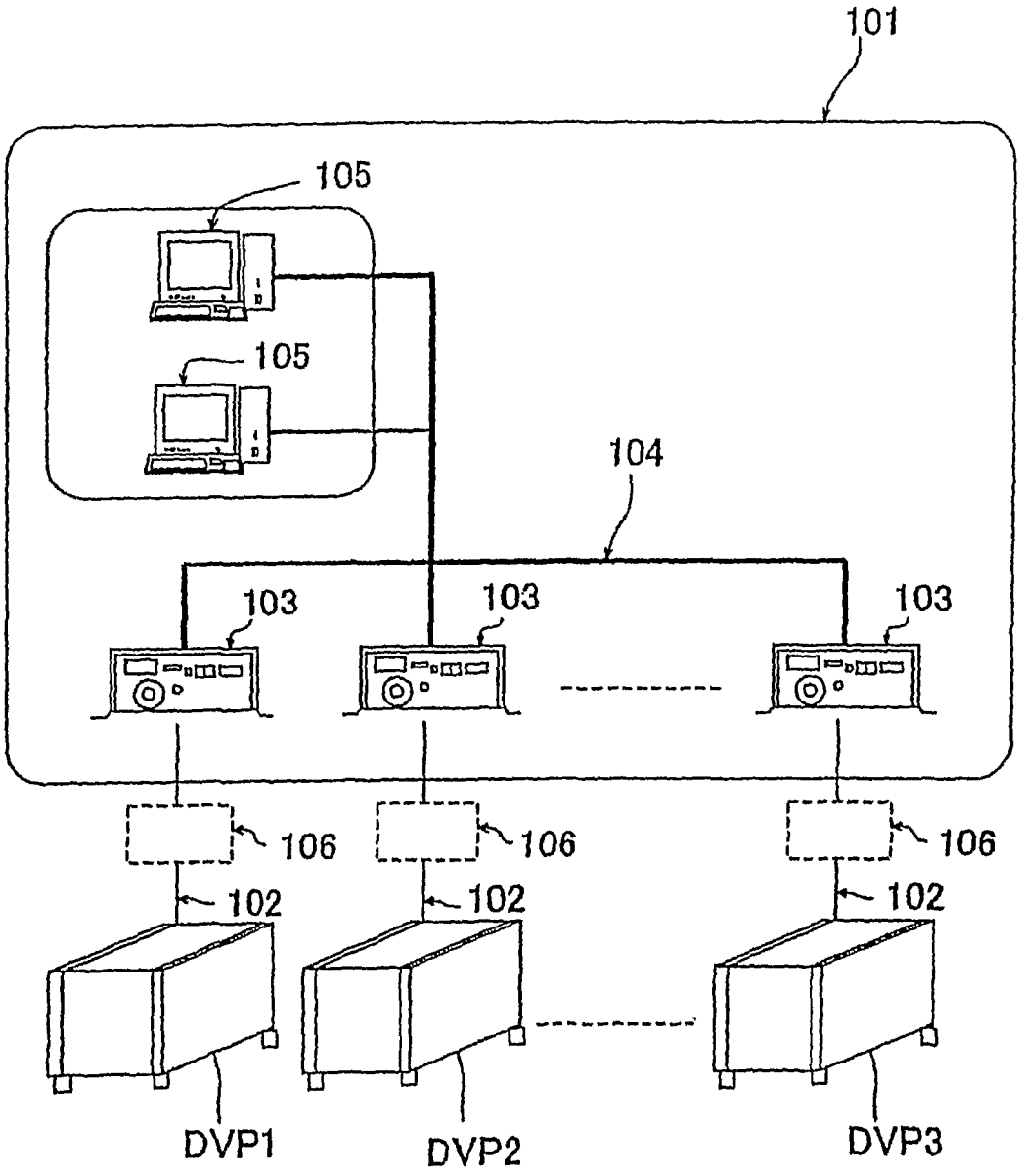
FIG. 8 is a diagram for describing an exemplary configuration of a current dry vacuum pump central monitoring system.

Next, a description will be given of a vacuum pump self-diagnosis system. FIG. 8 is a diagram illustrating an exemplary configuration of a current dry vacuum pump central monitoring system. Dry vacuum pumps DVP1, DVP2, . . . , DVPn are connected to associated Lon adapters 103 of the central monitoring system 101 through a communication network 102, and the respective Lon adapters 103 are interconnected through a network line 104. A plurality of central monitoring computers (personal computers) 105 are connected to the network line 104.

Pump data is transmitted from the dry vacuum pumps DVP1, DVP2 . . . , DVPn to the respective Lon adapters 103 through the communication network 102 in accordance with the RS232C communication scheme, and captured data is sent to the central monitoring computer 105 through the network line 104 for storage therein. One Lon network is capable of accommodating a maximum of 3,000 dry vacuum pumps DVP. The central monitoring computer 105 displays operating information (temperatures, current values and the like) of these dry pumps DVP1, DVP2, . . . , DVPn, and alarm information (alarm waning) and collectively manage the vacuum pumps which are installed in a semiconductor manufacturing factory or a liquid crystal manufacturing factory.

For building up the vacuum pump self-diagnosis system according to the present invention, the following aspects are required to take into consideration for the central monitoring system.

(1) A self-diagnosis function is added to an existing central monitoring system.

(2) Existing software for pumps are not changed.

(3) Data must be collected at intervals of approximately one second for capturing peak currents of the main pump which are generated in a pulsative manner. For keeping track of aging changes in the pumps, the data captured at intervals of approximately one second should be able to be preserved for one week or longer.

(4) The result of self-diagnosis can be monitored on the central monitoring computer 105 of an existing central monitoring system.

For satisfying the considerations (1)-(4), it is desirable that self-diagnosis adapters 106 (shown in dotted lines) are additionally installed between the dry vacuum pumps DVP1, DVP2 . . . , DVPn and the respective Lon adapters 103.

[Configuration of Vacuum Pump Self-Diagnosis System]

Figure 9:
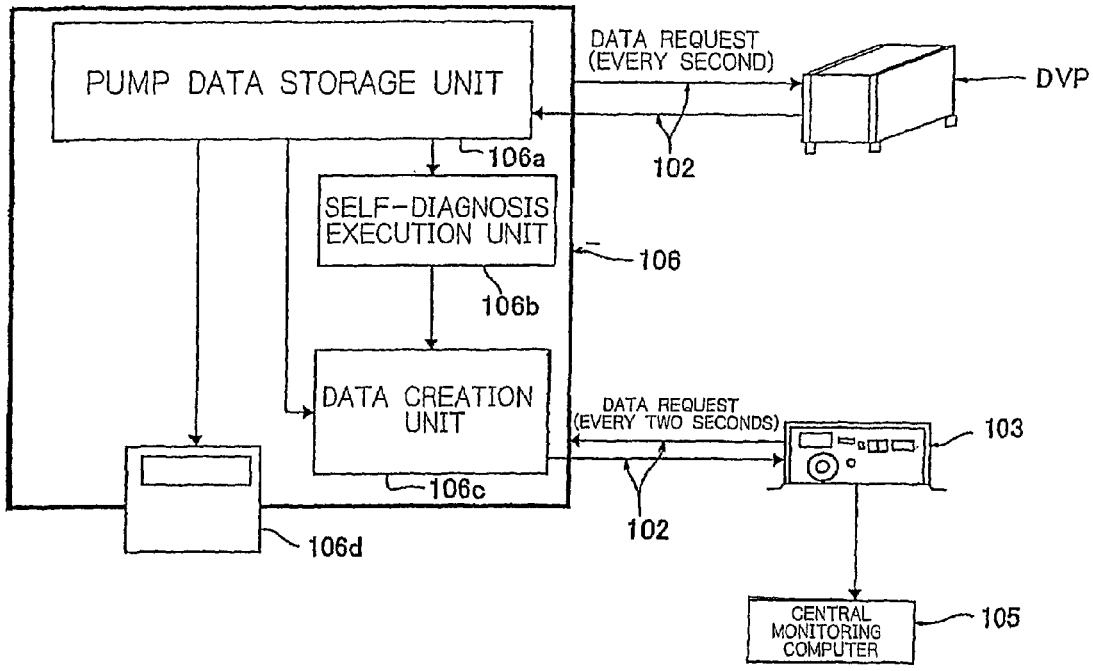
FIG. 9 is a diagram illustrating an exemplary configuration of a self-diagnosis adapter for a vacuum pump central monitoring system according to the present invention.

FIG. 9 is a diagram illustrating an exemplary system configuration of the self-diagnosis adapter which is installed between the dry vacuum pump DVP and Lon adapter. As illustrated, the self-diagnosis adapter 106 comprises a pump data storage unit 106*a*, a prediction execution unit 106*b*, and a data creation unit 106*c*. The self-diagnosis adapter 106 requests the dry vacuum pump DVP for pump data every second, and in response to the request, the dry vacuum pump DVP sends the pump data every second to the pump data storage unit 106*a* for storage therein. Simultaneously, the self-diagnosis execution unit 106*b* performs the self-diagnosis based on the self-diagnosis calculation flow illustrated in FIG. 3 with reference to the pump data stored in the pump data storage unit 106*a*. On the other hand, the self-diagnosis adapter 106, in response to the data request from the Lon adapter 103 every two seconds, adds self-diagnosis result data created by the self-diagnosis execution unit 106*b* to the latest data stored in the pump data storage unit 106*a*, and sends the resulting data to the Lon adapter 103.

The self-diagnosis adapter 106 in the foregoing configuration is connected between the respective dry vacuum pumps DVP1, DVP2, . . . , DVPn and the associated Lon adapters 104 connected thereto in the central monitoring system of FIG. 8. As a self-diagnosis result is sent from the self-diagnosis adapter 106, the central monitoring system displays a message on the central monitoring computer 105. In this event, since the self-diagnosis adapter 106 makes communications in a format compatible with existing central monitoring systems, no software need be changed for either the dry vacuum pumps DVP or Lon adapters 104. Also, the existing central monitoring systems have a limit in capability of data communication by the Lon network. If data is collected every second, the number of connectable pumps becomes very small. Consequently, it is configured that the pump data is stored and preserved in the pump data storage unit 106*a* in the self-diagnosis adapter 106.

Alternatively, the vacuum pump self-diagnosis unit comprising the pump data storage unit, self-diagnosis execution unit, and data creation unit may be provided in each Lon adapter 103 in FIG. 8. In addition, the vacuum pump self-diagnosis unit comprising the pump data storage unit, self-diagnosis execution unit, and data creation unit can be provided in a control unit (not shown) for controlling the dry vacuum pump DVP itself to provide a self-diagnosis system for an individual dry vacuum pump DVP.

Currently, the amount of pump data is approximately six megabytes per day, so that the self-diagnosis adapter 106 is required to preserve several tens to several hundreds megabytes of data for storing data for one week or longer. To implement this storage at a low cost, the self-diagnosis adapter 106 can employ a general compact flash (registered trademark) memory card 106*a*, which is used for digital cameras and the like, for the pump data storage unit. Also, a file system used in personal computers is employed for a preservation format, so that the collected data can be browsed as they are by a personal computer.

In one embodiment, the self-diagnosis adapter 106 is mounted with a memory card of 256 megabytes, so that the pump data sent from the dry vacuum pump DVP every second can be preserved for approximately six weeks. The self-diagnosis adapter 106 additionally comprises a total of three RS232C communication ports, two for input and output operations and one for a service personal computer, LED for displaying the state, a power supply for backing up the adapter for several seconds of powerless event in preparation of instantaneous power interruption, and the like. The alarm set value and the like for the self-diagnosis can be changed by dedicated software program running on a personal computer which can be directly connected to the self-diagnosis adapter 106.

While the foregoing example has shown the central monitoring system which employs the Lon network, any communication method can be applied to the central monitoring system. Also, the amount of preserved data can vary depending on a scale required to configure the self-diagnosis system.

Figure 10:
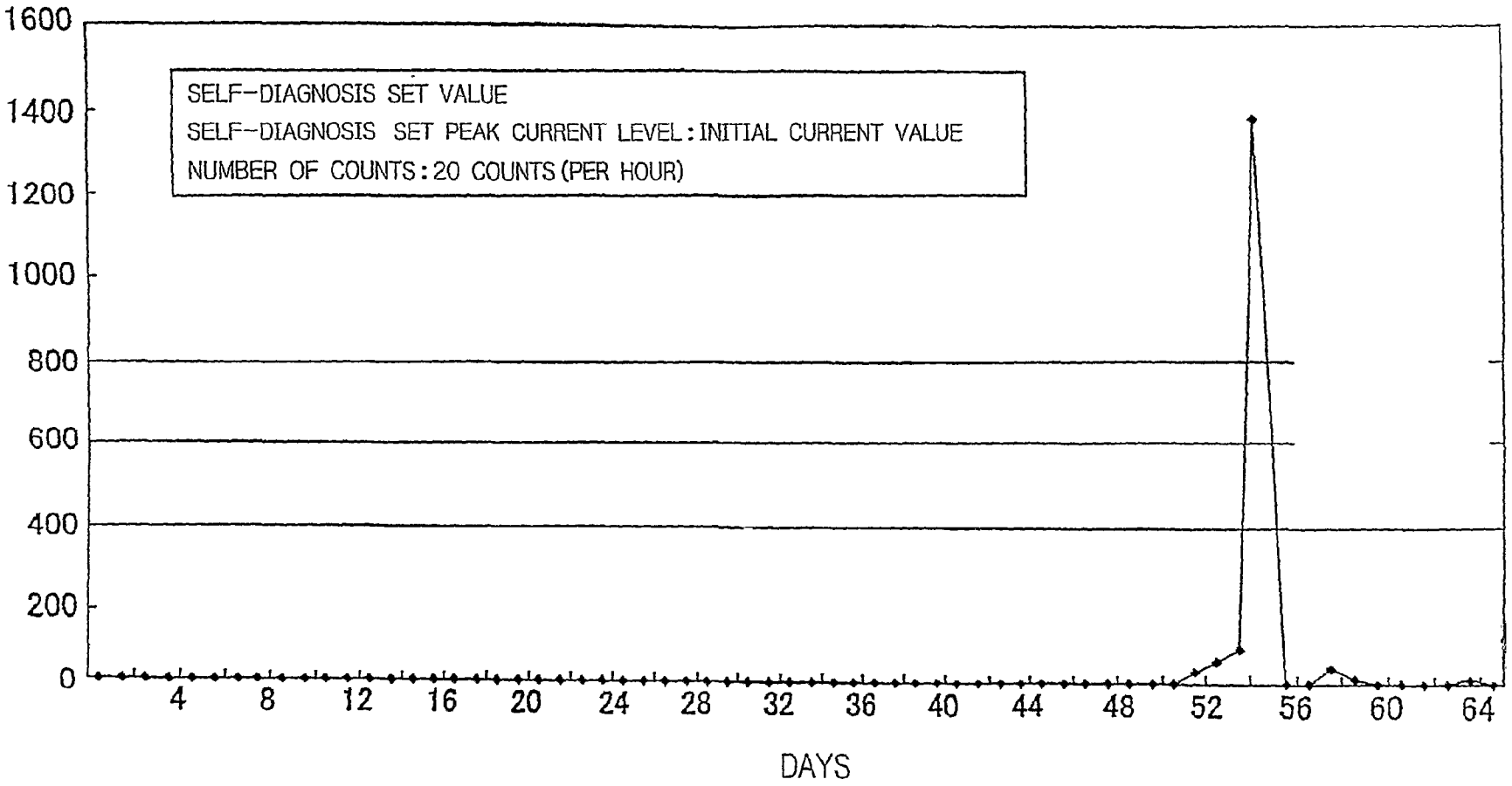
FIG. 10 is a diagram showing a change in the number of times a peak current is generated in the main pump.

For confirming the validity of the vacuum pump self-diagnosis system of the present invention, the self-diagnosis was actually performed for dry vacuum pumps DVP used in a P-CVD process of liquid crystal. While the pump current of the main pump was stable immediately after the pump current had been monitored, peak currents started to appear in the pump current value after operating for a certain period of time, eventually resulting in a stop of the main pump. A change in the number of times of the peak currents is shown in FIG. 10. As shown in FIG. 10, the pump was stopped on the 63rd day from the start of pump operation. FIG. 10 also shows that the number of peak currents appeared increases from when the pump was stopped (nine days before, in FIG. 10). For the main pump, it was confirmed that self-diagnosis can be made if an alarm is generated when the alarm set value is exceeded by the monitored number of times the peak current appears.

While the foregoing example has shown the result of an exemplary experiment in the vacuum pump self-diagnosis system with dry vacuum pumps used in a liquid crystal P-CVD process, there are a large number of heavy load processes which involve the deposition of reaction by-products within pumps, and it should be understood that self-diagnosis of a dry vacuum pump can be made in these processes as well by using the vacuum pump self-diagnosis system according to the present invention.

While some embodiments of the present invention have been described above, the present invention is not limited to the embodiments described above, but a variety of modifications can be made within the scope of the technical philosophy described in the claims, specifications, and drawings.

The invention claimed is:

1. A vacuum pump apparatus with a self-diagnosis system for evacuating a reaction chamber, comprising:

a Roots-type booster pump having a casing and a Roots-type rotor rotatably arranged in the casing for evacuating a reaction gas from the reaction chamber through rotation of the rotor driven by a first motor, wherein the Roots-type rotor has a plurality of rotor stages;

a main pump having a casing and a rotor rotatably arranged in the casing for evacuating a discharge of the booster pump through rotation of the rotor driven by a second motor;

a pressure sensor arranged to measure a pressure between the rotor stages in the casing of the Roots-type booster pump; and a control system which monitors and self-diagnoses the Roots-type booster pump and the main pump, wherein the control system is operable to:

monitor a first current of the first motor for driving the Roots-type rotor, a second current of the second motor for driving the rotor of the main pump, and the pressure between the rotor stages in the casing of the Roots-type booster pump measured by the pressure sensor, self-diagnose the booster pump and the main pump such that the control system generates an alarm when a value of the first current of the first motor for driving the Roots-type rotor exceeds a predetermined current value if the measured pressure between the rotor stages in the casing of the Roots-type booster pump is below a predetermined lower pressure value, and cancel the self-diagnosis if the measured pressure between the rotor stages in the casing of the Roots-type booster pump is above a predetermined higher pressure value.

2. The vacuum pump apparatus according to claim 1, wherein the main pump is a screw-type main pump and the rotor of the main pump is a screw-type rotor.

3. The vacuum pump apparatus according to claim 2, wherein the control system self-diagnoses the booster pump and the main pump such that the control system generates the alarm when the value of the first current of the first motor for driving the Roots-type rotor exceeds the predetermined value or when a number of current peaks per unit time of the second current of the second motor for driving the screw-type rotor exceeds a predetermined peak number, if the measured pressure between the rotor stages in the casing of the Roots-type pump is below the predetermined lower pressure value.

4. The vacuum pump apparatus according to claim 1, wherein the value of the first current is an average value of the first current per a predetermined time period.

5. The vacuum pump apparatus according to claim 1, wherein the value of the first current is an integrated value of the first current per a predetermined time period.

6. The vacuum pump apparatus according to claim 5, wherein the control system is further operable to abort the integration and reset the predetermined current value, when the measured pressure is between the predetermined lower pressure value and the predetermined higher pressure value, so that the difference between the measured current value and the measured current value at a time when the measured pressure becomes lower than the predetermined lower value before the reset can be compared to the predetermined current value before the reset.

7. The vacuum pump apparatus according to claim 1, wherein the predetermined higher pressure value is higher than a pump inner pressure measured by the pressure sensor when the booster pump and the main pump are operated during a cleaning process of the reaction chamber.

8. The vacuum pump apparatus according to claim 1, wherein the predetermined lower pressure value is set so that the predetermined lower pressure is higher than a pump inner pressure measured by the pressure sensor when the booster pump and the main pump are operated during a deposition process of the reaction chamber.

* * * * *